US006264759B1

(12) United States Patent
Bae et al.

(10) Patent No.: US 6,264,759 B1
(45) Date of Patent: Jul. 24, 2001

(54) WIRE RODS WITH SUPERIOR DRAWABILITY AND MANUFACTURING METHOD THEREFOR

(75) Inventors: Chul Min Bae; Jae Hwan Kim, both of Kyungsangbook-do (KR)

(73) Assignee: Pohang Iron & Steel Co., Ltd. (KR)

( * ) Notice: Subject to any disclaimer, the term of this patent is extended or adjusted under 35 U.S.C. 154(b) by 0 days.

(21) Appl. No.: 09/418,620

(22) Filed: Oct. 15, 1999

(30) Foreign Application Priority Data

Oct. 16, 1998 (KR) ..... 98-43340
Dec. 23, 1998 (KR) ..... 98-57632

(51) Int. Cl.[7] ..... C21D 8/06

(52) U.S. Cl. ..... 148/320; 148/330; 148/333; 148/598

(58) Field of Search ..... 148/598, 333, 148/330, 320; 428/606

(56) References Cited

U.S. PATENT DOCUMENTS 5,156,692 10/1992 Tsukamoto ..... 148/320
5,458,699 * 10/1995 Tsukamoto et al. ..... 148/598

FOREIGN PATENT DOCUMENTS 53-52229 * 5/1978 (JP) ..... 148/598
63-4039 1/1988 (JP) .
1-165795 6/1989 (JP) .
40-146618 * 6/1991 (JP) ..... 148/598
4-254526 9/1992 (JP) .
4-325627 11/1992 (JP) .
4-346619 12/1992 (JP) .
5-105966 4/1993 (JP) .
6-136452 5/1994 (JP) .
97-43188 7/1997 (KR) .

OTHER PUBLICATIONS

Languillaume, J. et al., "Evolution of the tensile strength in heavily cold drawn and annealed peralitic steel wires", *Materials Letters,* Dec. 1997, pp. 241–245.
Tashiro, Hitoshi, "Change in Mechanical Properties of Wires Strenghtened by Cold Drawing during the Low Temperature Annealing", *Camp–ISIJ,* vol. 8, 1995, p. 1373.
Nakamura, Kenichi, "Effect of C and Cr on the Elongation in High Carbon Steel Wires Strengthened by Drawing", *Camp–ISIJ,* vol. 11, 1998, p. 347.

* cited by examiner

*Primary Examiner*—Deborah Yee
(74) *Attorney, Agent, or Firm*—Webb Ziesenheim Logsdon Orkin & Hanson, P.C.

(57) ABSTRACT

A method for manufacturing wire rods and steel wire for use in making bead wires, wire ropes and springs is disclosed. That is, high drawability wire rods and a manufacturing method therefor are disclosed, in which the wire drawing is possible without carrying out patenting (an intermediate heat treatment). The high drawability wire rods for making high strength steel wire includes a steel containing, in wt %, 0.4–0.65% of C, 0.1–1.0% of Si, 0.1–1.0% of Mn, 0.3% or less of Cr, 100 ppm or less of B, Fe and other unavoidable impurities. The steel further contains 0.02% or less of one or more elements selected from a group consisting of Ti, Nb and V. The steel has a degenerated pearlite structure with pro-eutectoid ferrite of 10% or less, the remaining part being a discontinuously formed cementite. A billet having the above composition is hot-rolled, and is cooled at a cooling rate of 10–30° C./sec.

7 Claims, 3 Drawing Sheets

WIRE RODS WITH SUPERIOR DRAWABILITY AND MANUFACTURING METHOD THEREFOR

BACKGROUND OF THE INVENTION

The present invention relates to a method for manufacturing wire rods and steel wire for use in making bead wires, wire ropes and springs. More specifically, the present invention relates to high drawability wire rods and a manufacturing method therefor, in which wire drawing is possible without carrying out a patenting (an intermediate heat treatment during the drawing).

DESCRIPTION OF THE PRIOR ART

Generally, in making wire rods as a raw stock for bead wires, wire ropes and springs having high strength, two methods have been proposed in which wire drawing is carried out on the wire rods while raising the strength of the rods, or the drawing strength due to the work hardening phenomenon during the wire drawing is utilized. These are the major two methods which are currently used. However, the raising of the strength is accompanied by the lowering of the ductility, and therefore, a patenting has to be carried out before reaching the target wire diameter. On the other hand, if the strength of the steel wire is improved by increasing the drawing strain, there is the advantage that the patenting can be skipped, but delamination is liable to occur, thereby making it difficult to secure the high strength.

Specifically, in most of the conventional techniques, in order to improve the drawability of a carbon steel, the austenite grain sizes are made fine in a high carbon steel with a C content of more than 0.7%, thereby securing the drawability. For example, U.S. Pat. No. 5,156,692 discloses the following technique. That is, a deformation is controlled to be undergone at a high temperature, and thus, the grain size of the austenite is controlled to about 5 $\mu$m. In this manner, the drawability is improved by making the interlamellar spacing fine and by forming the fine pearlite colonies.

Another example is Japanese Patent Laid-open No. Hei-6-136452. In this method, when carrying out the patenting, AlN is precipitated, thereby inhibiting the growth of the austenite grains. However, if the austenite grains are made fine in this manner, in the case of a medium carbon steel, the volume fraction of the ferrite is increased, so that the drawability is rather aggravated. Accordingly, this method cannot be applied to the medium carbon steel.

As still another example, there is Japanese Patent Laid-open No. Hei-4-325627. In this method, a large amount of Si is added to the steel, and thus the strength and ductility of the steel are improved by the solution hardening. However, if Si is added in a large amount, decarburization is caused during the rolling.

Besides, there are other methods of improving the strength and the ductility by adding alloy elements or by controlling the cooling rate. Typical examples of them are Japanese Patent Laid-open No. Sho-63-4039, Hei-4-346619 and Hei-4-254526.

In the case of Japanese Patent Laid-open No. Sho-63-4039, there is prepared a steel which contains 0.7–0.95% of C, 0.2–0.5% of Si, 0.4–0.7% of Mn, 0.05–0.2% of V, and 0.05–0.5% of Ni. The drawing and patenting are repeated to manufacture a wire of about 0.3 mm.

In the case of Japanese Patent Laid-open No. Hei-4-346619, a carbon steel which contains, in wt %, 0.6–1.1% of C, 0.1–0.2% of Si, and 0.1–2.0% of Mn is subjected to a patenting. Then a drawing is carried out by more than 60%, and then, the steel is maintained at a temperature of 50–200° C. for 5 minutes to 1 hour. Thus the ductility aggravation which is caused by the strain aging during the drawing is compensated, thereby obtaining a superior steel wire.

However, in the above two methods, the ductility of the steel wire cannot be increased, and therefore, there is a problem in increasing the drawing strain without carrying out the patenting.

In Japanese Patent Laid-open No. Hei-4-254526, a steel which contains 0.9–1.3% of C, 0.1–2.0% of Si and 0.1–1.3% of Cr is hot-rolled. Then a rapid cooling is carried out down to a temperature at which the pro-eutectoid cementite is produced. Then a cooling is carried out at a rate of 8° C./sec down to a temperature at which the pearlite transformation is terminated. Or the rapid cooling is carried out down to the pearlite transformation temperature, and then, the steel is isothermally maintained, thereby inhibiting the formation of the pro-eutectoid cementite, and improving the ductility of the drawn wire. In this method, however, the pro-eutectoid cementite is not formed at a carbon content of less than 0.9%, and therefore, the method cannot be applied to this case. Further, after the actual rolling, there is a difficulty in controlling the cooling by dividing the cooling step into two stages.

As described above, in most of the conventional techniques, an intermediate heat treatment called patenting is necessarily carried out during the drawing. That is, the patenting is for controlling the strained structure which has been formed during the drawing. It is a well known fact that the patenting has to be necessarily undergone if the wire is to be drawn to the final wire diameter.

However, if the drawability is ensured without carrying out the patenting, then there are various advantages as follows. That is, the raw stock can be drawn directly to the final product, and the pickling for removing the scales produced as a result of the patenting can be skipped. Further, the lubricant coating for carrying out the drawing can also be skipped. In fact, however, if wire drawing is carried out without the patenting, the ductility of the stock is markedly aggravated due to the work hardening, with the result that breaking may occur during the drawing, and that the delamination may be found after the drawing. The delamination is increased proportionally to the strength of the stock and to the drawing strain. Particularly it is known that if the drawing strain is increased, the delamination is more frequent compared with the case where the strength of the stock is strengthened.

Meanwhile, in steel wires such as bead wire, it is required that the elongation be more than 5%. Therefore conventionally, in order to secure the elongation, a carbon steel of 0.7–0.8%C was subjected to drawing, patenting and drawing, and then, bluing was carried out in a Pb bath. However, the bluing tends to cause lowering of the strength of the steel wire proportionally to the recovery of the elongation. That is, if the bluing is carried out in the general manufacturing method, the elongation is restored, but the tensile strength is lowered by about 20 Kg/mm$^2$. Therefore, a steel wire which has a tensile strength of 250 Kg/mm$^2$ will have a tensile strength of 230 Kg/mm$^2$ after the bluing. If a strength of 200 Kg/mm$^2$ is to be obtained in a bead wire, at least a strength of 220 Kg/mm$^2$ has to be secured. However, in the case of the usual carbon steel, if the drawing strain is 95% or more, the elongation is recovered by not more than 5%. Thus, in order to secure the elongation, if the bluing is carried out at a high temperature, the tensile strength is greatly lowered (so it is known) (materials letter, 1997, p241). In the case of a low carbon steel which has a superior ductility, the restoration of the elongation is not well realized after the drawing (so it is known) (CAMP-ISIJ vol 8, 1995, p1373). Further, in the usual drawing amount, if the carbon content is less than 0.6%, it is difficult to obtain an elongation of more than 5% after the bluing (so it is known) (CAMP-ISIJ, vol. 11, 1998, p347).

Therefore it is proposed as follows. That is, in the case of the wire rods for making the bead wire, adding alloy elements into a high carbon steel or modifying the bluing process is proposed. For example, Japanese Patent Laid-open No. Hei-5-105966 proposes as follows. That is, in a steel which contains 0.9–1.1% of C and Cr and Mn, the patenting conditions are modified to make the fine structure become a bainite so as to obtain a bead wire with a strength of 250 Kg/mm$^2$ and an elongation of 8%. Japanese Patent Laid-open No. Hei-1-165795 proposes the following technique. That is, the bluing is not carried out after the drawing, and then an elongation is recovered during the wire manufacturing process. Therefore, the wire installation method is improved so as to skip the bluing. However, even in this method, the patenting or a similar separate treatment is required, and therefore, the productivity cannot be improved.

SUMMARY OF THE INVENTION

The present invention is intended to overcome the above described disadvantages of the conventional techniques.

Therefore it is an object of the present invention to provide wire rods for making high strength steel wire, in which the carbon content is lowered, and alloy elements are added, thereby eliminating patenting.

It is another object of the present invention to provide a method for manufacturing wire rods for making high strength high ductility steel wire, in which the patenting is skipped, but a superior productivity is realized.

It is still another object of the present invention to provide high strength high ductility steel wire in which wire rods are drawn without carrying out patenting, and bluing is carried out at a proper temperature, thereby obtaining a tensile strength of more than 200 Kg/mm$^2$ and an elongation of 5% or more.

It is still another object of the present invention to provide a method for manufacturing high strength high ductility steel wire with a superior productivity, in which wire rods are manufactured by skipping patenting, and then, bluing is carried out at a proper temperature.

In achieving the above objects, the high drawability wire rods for making high strength steel wire according to the present invention includes: a steel containing, in wt %, 0.4–0.65% of C, 0.1–1.0% of Si, 0.1–1.0% of Mn, 0.3% or less of Cr, 100 ppm or less of B, Fe and other unavoidable impurities; the steel further containing 0.02% or less of one or more elements selected from a group consisting of Ti, Nb and V; and the steel having a degenerated pearlite structure with pro-eutectoid ferrite of 10% or less, the remaining part being a discontinuously formed cementite.

In another aspect of the present invention, the method for manufacturing high drawability wire rods for making high strength steel wire according to the present invention includes the steps of: hot-rolling a billet containing, in wt %, 0.4–0.65% of C, 0.1–1.0% of Si, 0.1–1.0% of Mn, 0.3% or less of Cr, 100 ppm or less of B, Fe and other unavoidable impurities, and further containing 0.02% or less of one or more elements selected from a group consisting of Ti, Nb and V; and continuously cooling at a cooling rate of 10–30° C./sec.

In still another aspect of the present invention, the high strength steel wire according to the present invention includes: a steel containing, in wt %, 0.4–0.65% of C, 0.1–1.0% of Si, 0.1–1.0% of Mn, 0.3% or less of Cr, 100 ppm or less of B, Fe and other unavoidable impurities; the steel further containing 0.02% or less of one or more elements selected from a group consisting of Ti, Nb and V; the steel having a degenerated pearlite structure with pro-eutectoid ferrite of 10% or less, the remaining part being a discontinuously formed cementite; and the steel wire having a tensile strength of 200 Kg/mm$^2$ or more and an elongation of 5% or more.

In still another aspect of the present invention, the method for manufacturing high strength steel wire according to the present invention includes the steps of: hot-rolling a billet containing, in wt %, 0.4–0.65% of C, 0.1–1.0% of Si, 0.1–1.0% of Mn, 0.3% or less of Cr, 100 ppm or less of B, Fe and other unavoidable impurities, and further containing 0.02% or less of one or more elements selected from a group consisting of Ti, Nb and V; continuously cooling at a cooling rate of 10–30° C./sec; drawing wire rods thus obtained into the steel wire; and carrying out bluing at a temperature of 450–550° C. for 2–60 seconds.

BRIEF DESCRIPTION OF THE DRAWINGS

The above objects and other advantages of the present invention will become more apparent by describing in detail the preferred embodiment of the present invention with reference to the attached drawings in which.

DETAILED DESCRIPTION OF THE PREFERRED EMBODIMENT

Figure 1A:
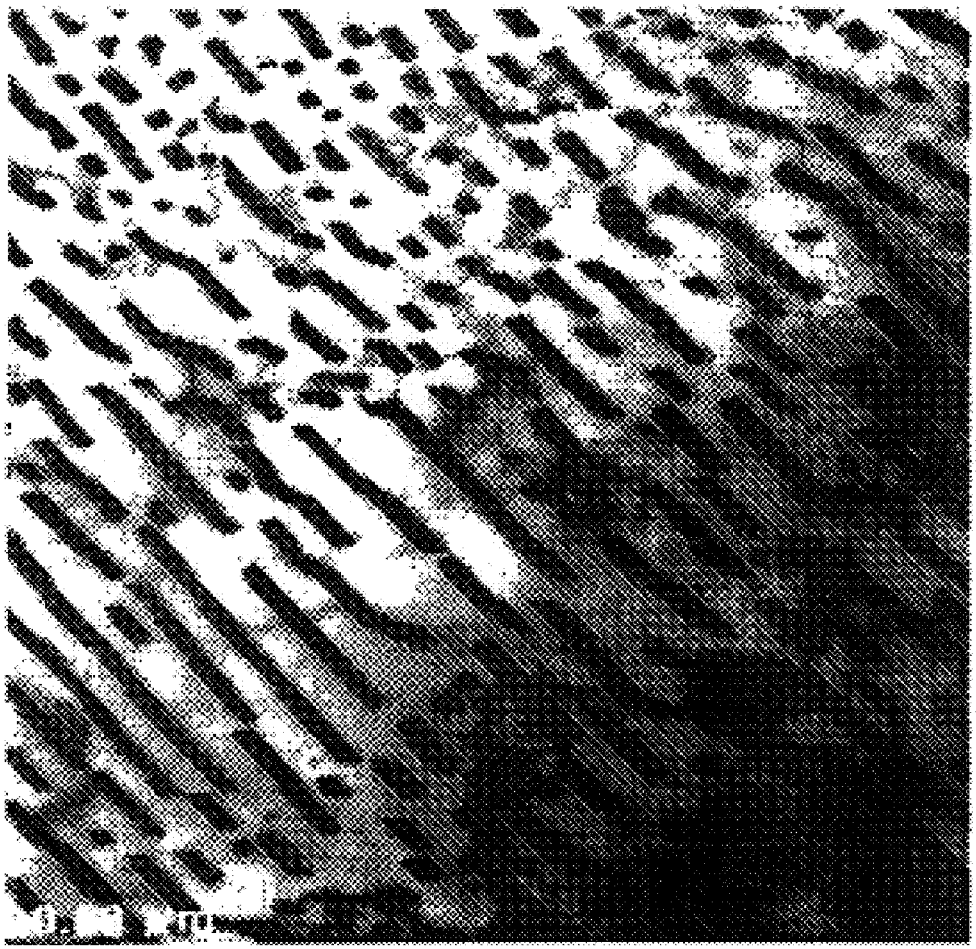
FIG. 1*a* is a photograph showing the structure of the wire rods according to the present invention.

First, the high drawability wire rods for making high strength steel wire according to the present invention will be described.

The high drawability wire rods for making a high strength steel wire according to the present invention include: a steel containing 0.4–0.65% of C, 0.1–1.0% of Si, 0.1–1.0% of Mn, 0.3% or less of Cr, 100 ppm or less of B, Fe and other unavoidable impurities; the steel further containing 0.02% or less of one or more elements selected from a group consisting of Ti, Nb and V; and the steel having a degenerated pearlite structure with pro-eutectoid ferrite of 10% or less, the remaining part being a discontinuously formed cementite.

Generally, in wire rods, the drawability is lowered during drawing due to the formation of cracks. According to Korean Patent Laid-open No. 97-43188, the cracks of the wire rods are formed on the grain boundary cementites which exclusively exist on the ferrite /pearlite boundaries and on the grain boundaries in the case where the wire rods have a ferrite /pearlite structure. In contrast to this, in the case of wire rods having single pearlite microstructure, the cracks are formed by the cracking of the cementites. Further, in a high carbon steel having a high volume fraction of cementite, the drawability is low compared with the low carbon steel.

Based on this fact, the carbon content is lowered in the wire rods of the present invention compared with the eutectoid steel, thereby decreasing the volume fraction of the cementite. Further, an alloying design is carried out to improve the hardenability of the stock, so that ferrite transformation can be inhibited during the cooling after the rolling.

Specifically, the respective ingredients of the wire rods according to the present invention will be reviewed.

Carbon is an element which is most effective in increasing the strength, and therefore, its content is varied depending on the use of the wire rods. However, if the C content is less than 0.4 wt % (to be expressed "%" below), the matrix structure becomes ferrite, and thus, increasing the ferrite volume fraction is very easy when compared to increasing the pearlite volume fraction, so that the securing of high strength becomes difficult. On the other hand, if the C content exceeds 0.65%, the pearlite volume fraction becomes more than 95% despite non-adding of alloy elements, but delamination easily occurs when drawing strain is increased, and therefore, it becomes undesirable. Therefore, the C content should be preferably 0.4–0.6%.

Silicon is an element needed for deoxidation of the steel. If its content is too low, the deoxidation becomes insufficient, and therefore, at least 0.1% or more of Si should be added. Further, Si is an effective ferrite solid-solution-hardening element, and therefore, the inter-lamellar spacing of the pearlite becomes fine during continuous cooling and decrease of the strength is prevented during heat treatment of the drawn stock. However, if its content is too excessive, decarburization occurs during the heating of the stock for hot rolling, and the removal of the scales for carrying out drawing becomes difficult. Therefore its upper limit should be 1.0%. Accordingly, the Si content should be preferably limited to 0.3–0.8%.

Manganese not only gives a deoxidation effect but also forms manganese sulfide (MnS) during the manufacture of the steel so as to inhibit the red shortness. For this, Mn should be added at least in an amount of 0.1% or more. Further, Mn raises the strength of the stock, and makes the inter-lamellar spacing of the pearlite fine. However, if it is added excessively, the occurrence of segregations is highly possible, and the threshold cooling rate for bringing the martensite is lowered. Further, compared with other elements, Mn markedly lowers the drawing limit, and therefore, its upper limit should be 1.0%. More preferably, the Mn content should be limited to 0.4–0.7%.

Chrome increases the hardenability of the steel, and makes the inter-lamellar spacing fine to increase the strength and the ductility. However, if it is added excessively, martensites may occur during the cooling of the stock, and therefore, its upper limit should be 0.3%. More preferably the Cr content should be limited to 0.15–0.25%.

Boron reinforces the hardenability of the stock (as does Cr) to inhibit the formation of ferrite. Further, it promotes the growth of cementites within the pearlite, so that small defects occurring on the ferrite /pearlite boundaries during the drawing are inhibited. However, if its content is excessive, it is bonded with N to form borides, and therefore, ruptures will occur during hot rolling, and also if its content is above 0.01% or more, the hardenability of the stock is not improved. Therefore, the B content should be preferably limited to 10–30 ppm.

Meanwhile, Ti, Nb and V are bonded with C or N to form carbides or nitrides, thereby maximizing the effect of B. However, if their contents are too high, the ductility of the ferrite is lowered due to large amounts of precipitates. Further, a low temperature structure such as martensite may occur due to the solid solution hardening. Therefore, their total upper limit should 0.02%.

In the wire rods of the present invention having the above described composition, the volume fraction of the pro-eutectoid ferrite is 10% or less, and the remaining part is a degenerated pearlite structure. That is, in the wire rods of the present invention, the volume fraction of the pearlite is 90% or more even without raising the heating temperature and without raising the laying head temperature. Particularly, in the wire rods of the present invention, the pearlite structure is degenerated, and therefore, high ductility wire rods can be obtained. Further, in the wire rods of the present invention, the drawability is ensured even without carrying out patenting, thereby obtaining wire rods for high strength high ductility steel wire. Preferably, the cementite proportion within the pearlite structure is maintained at 6–10%.

Meanwhile, the steel wire of the present invention not only has the above described composition and structure, but also drawing and bluing are carried out by skipping the patenting, with result that a strength of 200 $Kg/mm^2$ or more and an elongation of 5% or more are secured.

Now the method for manufacturing the wire rods according to the present invention will be described.

In carrying out the method of the present invention, first an ingot or a billet having the above described composition is hot-rolled. Then the hot rolled steel is continuously cooled at a rate of 10–30° C./sec. This cooling rate is a proper level for the general wire rods. This is meant that the present invention is easily applicable to the relevant field of industries. Further, this cooling rate has the advantage that the hot rolling finish temperature may be lowered. That is, if the above mentioned cooling rate is maintained, the heated temperature of the billet may be 1100–1000° C., and more preferably 1050±30° C. However, in the case where a cooling rate of less than 10° C./sec is adopted, the precipitation of the pro-eutectoid ferrite becomes excessive in spite of addition of the alloy elements. Therefore, aggravation of the strength and delamination may occur at the final wire diameter. Meanwhile, at above the rate of 30° C./sec, martensites are precipitated, with the result that breaking may occur during the drawing, thereby making it undesirable.

In this manner, if the alloy element design and the above described cooling rate are applied in manufacturing the wire rods of the present invention, then high strength high ductility steel wire can be manufactured even without carrying out patenting which is an indispensable process in the conventional methods.

Meanwhile, in the method for manufacturing high strength high ductility steel wire, bluing is carried out at a temperature of 450–550° C. to obtain a tensile strength of 200 $Kg/mm^2$ or more and an elongation of 5% or more, in addition to the process steps of the wire rods manufacturing process of the present invention. In other words, steel wire which has been drawn without carrying out patenting is subjected to bluing treatment, thereby obtaining high strength high ductility steel wire. Under this condition, the bluing is carried out at a temperature of 450–550° C. within a Pb bath for 2–60 seconds as is usually done.

Depending on the degree of the strain during the wire drawing before carrying out the bluing, there is the possibility that delamination may occur or the elongation is not recovered. Therefore, it is necessary to limit the strain during the wire drawing. In the present invention, the strain is limited to 3.5.

Now the present invention will be described based on actual examples.

EXAMPLE 1

Steel ingots having chemical compositions of Table 1 were prepared. They were subjected to a continuous casting to form billets of 160×160 mm. Then they were heated to 1050° C., and then hot rollings were carried out. Then they were cooled at a cooling rate of 25° C., and then, were manufactured into wire rods with a diameter of 5.5 mm. Then for the stocks, the pro-eutectoid ferrite, the cementite proportions and the mechanical properties were evaluated, and the evaluation results are shown in Table 1 below.

TABLE 1

| | Chemical composition (wt %) | | | | | | Ferrite volume fraction | Test results | |
|---|---|---|---|---|---|---|---|---|---|
| | | | | | | | | Tensile strength | Reduction of area |
| Examples | C | Si | Mn | Cr | B | Ti | (%) | (Kg/mm$^2$) | (%) |
| Inventive material 1 | 0.52 | 0.3 | 0.4 | 0.2 | — | — | 7 | 88 | 58 |
| Inventive material 2 | 0.52 | 0.8 | 0.4 | 0.2 | — | — | 6 | 97.1 | 61.5 |
| Inventive material 3 | 0.52 | 0.8 | 0.7 | 0.16 | — | — | 5 | 102.7 | 59.6 |
| Inventive material 4 | 0.57 | 0.8 | 0.4 | 0.2 | — | — | 4 | 101.9 | 55.7 |
| Inventive material 5 | 0.53 | 0.3 | 0.7 | — | 0.0013 | 0.01 | 2 | 98 | 63 |
| Comparative material a | 0.52 | 0.3 | 0.4 | — | — | — | 24 | 81.9 | 56.4 |
| Comparative material b | 0.72 | 0.3 | 0.4 | — | — | — | 2 | 105.6 | 48 |
| Comparative material c | 0.80 | 0.3 | 0.4 | — | — | — | 0.5 | 118 | 44.9 |

The comparative material a of Table 1 was a steel which was the same as the steel of the present invention, except that the alloy elements were not added. The comparative materials b and c were wire rods for making the general high strength steel wire in which the carbon content is high.

As can be seen in Table 1 above, in the inventive materials 1–5, the pro-eutectoid ferrite volume fractions were controlled to less than 10%. Therefore, the reduction of area which shows the ductility was greatly improved. On the other hand, in the comparative materials b and c which were the wire rods for making the general high strength steel wire, the reduction of area was markedly aggravated, while in the comparative material a containing no alloy elements, although the reduction of area was adequate, the ferrite volume fraction was high, and therefore, there was the possibility that cracks would be formed during drawing.

Figure 1B:
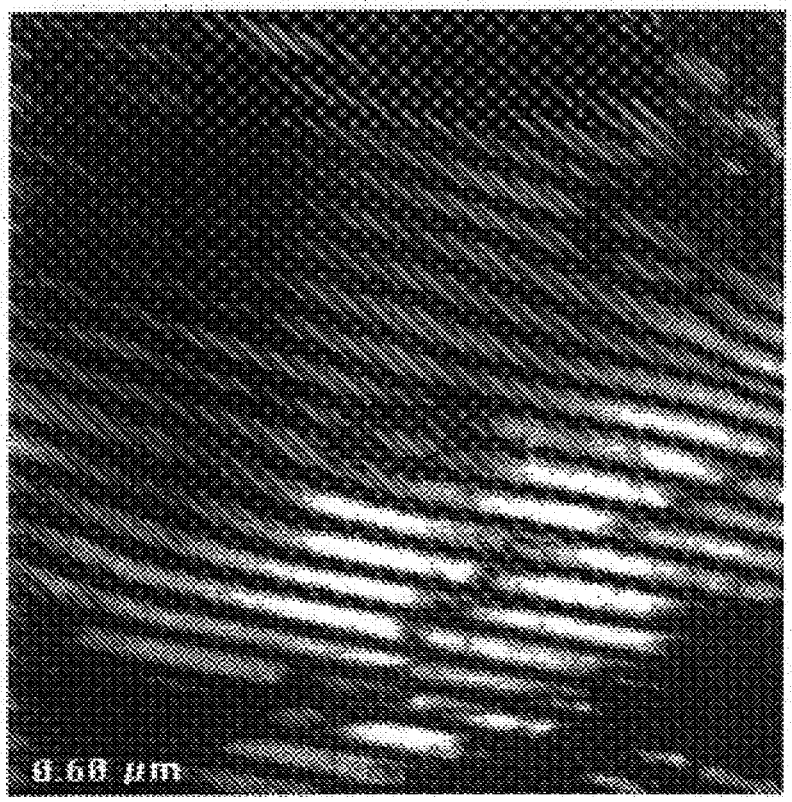
FIG. 1b PRIOR ART
FIG. 1*b* is a photograph showing the structure of conventional wire rods.

This fact can be described by referring to FIG. 1 which shows the structures of the inventive material 5 and the comparative material c. That is, in the case of the inventive material 5 having a carbon content of 0.4–0.65%, there was seen a degenerated pearlite phase as is seen in FIG. 1*a*. Meanwhile, in the case of the comparative material c having a carbon content of 0.7–0.8%, there was seen a continuous ferrite phase as is seen in FIG. 1*b*. This difference between the two materials will give a great influence to the final wire rod product.

EXAMPLE 2

For the respective wire rods of example 1, wire drawings were carried out to diameters of 5.5 mm to 0.96 mm. Then the strengths of the wires, the area reduction rates, the elongations and the occurrence of delaminations were checked. The checked results are shown in Table 2 below. For the drawing of the wire rods, the strain is defined to be $\epsilon=2\ \ln(Do/D)$, where Do is the diameter of the wire rods stock to be drawn, and D is the diameter after the drawing. In the present invention, the strain was about 3.5.

TABLE 2

| | | | Test result | | | |
|---|---|---|---|---|---|---|
| Examples | Steel | Patenting | Tensile strength (Kg/mm$^2$) | Reduction of area (%) | Elongation (%) | Delamination |
| Inventive example 1 | Inventive material 1 | None | 233 | 43.6 | 3.1 | None |
| Inventive example 2 | Inventive material 2 | None | 251 | 49.2 | 2.86 | None |
| Inventive example 3 | Inventive material 3 | None | 275.8 | 48.3 | 3.18 | None |
| Inventive example 4 | Inventive material 4 | None | 271.2 | 48.3 | 2.99 | None |
| Inventive example 5 | Inventive material 5 | None | 247.4 | 46.7 | 3 | None |

TABLE 2-continued

| Examples | Steel | Patenting | Test result | | | |
|---|---|---|---|---|---|---|
| | | | Tensile strength (Kg/mm$^2$) | Reduction of area (%) | Elongation (%) | Delamination |
| Comparative example 1 | Comparative material a | None | 212 | 47 | 2.5 | Occurred |
| Comparative example 2 | Comparative material b | None | 274 | 20 | 1.5 | Occurred |
| Comparative example 3 | | Applied | 223 | 36.6 | 2.8 | None |
| Comparative example 4 | Comparative material c | None | 290 | 10 | 1.36 | Occurred |
| Comparative example 5 | | Applied | 235 | 42.5 | 2.98 | None |

As shown in Table 2 above, the comparative example 1 was obtained by wire-drawing the comparative material a to a drawing strain of 3.5 without carrying out patenting. In this case, not only the tensile strength was low, but also delaminations occurred.

Meanwhile, in the cases of the comparative examples 2 and 4, the comparative materials b and c which were the wire rods for making the general high strength steel wire were drawn without carrying out patenting. When they were drawn to a drawing strain of 3.5, a high strength steel wire could be obtained. However, delaminations occurred, thereby making them improper. On the other hand, the comparative examples 3 and 5 were those in which the comparative materials b and c (which were the wire rods for making the general high strength steel wire) were drawn without carrying out patenting. In these cases, no delaminations occurred.

On the other hand, in the cases of the inventive examples 1–5, the drawing was carried out to a drawing strain of 3.5 without carrying out patenting unlike the comparative examples 3 and 5. In these cases, a high strength steel wires could be obtained without delamination.

EXAMPLE 3

Wire rods were prepared like in Example 1, except that the comparative material a of Example 1 was heated to 1150° C. In the case of the comparative material a in which the alloy elements were not added, the pro-eutectoid ferrite volume fraction was 6%, the tensile strength was 85.3 Kg/mm$^2$, and the reduction of area was 59%. That is, in the case of the comparative material a in which the alloy elements were not added, a high temperature heating up to 1150° C. was required if the pro-eutectoid ferrite proportion was to be maintained to below 10%.

Meanwhile, the wire rods thus obtained were drawn to a drawing strain of 3.5 without carrying out patenting like in Example 2, thereby obtaining steel wire with a diameter of 0.96 mm. Then the strength of the steel wire, the area reduction and the elongation were measured, and the measured results are shown in Table 3 below.

TABLE 3

| Examples | Steel | Patenting | Test result | | | |
|---|---|---|---|---|---|---|
| | | | Tensile strength (Kg/mm$^2$) | Reduction of area (%) | Elongation (%) | Delamination |
| Comparative example 6 | Comparative material a | None | 230.3 | 45.1 | 2.63 | None |

As can be seen in Table 3 above, in the case of the comparative example 6 in which the comparative material a was used and in which the alloy elements were not added, there was obtained a tensile strength of 230 Kg/mm$^2$ without any occurrence of delamination. However, compared with the inventive examples of the present invention, its strength was significantly low. Further, if a pro-eutectoid ferrite volume fraction of 10% or less is to be maintained, a high temperature heating up to 1150° C. was required, and therefore, its industrial usefulness is significantly low.

EXAMPLE 4

From among the steel wires manufactured in Example 2, there were selected the inventive examples 2, 4 and 5 in which the delaminations did not occur. They were dipped into a Pb bath at a temperature of 400–550° C. for 3–300 seconds, thereby carrying the bluing. Further, bluing was carried out on the steel wire of the comparative example 6 of Example 3 in which the delaminations did not occur.

Figure 2:
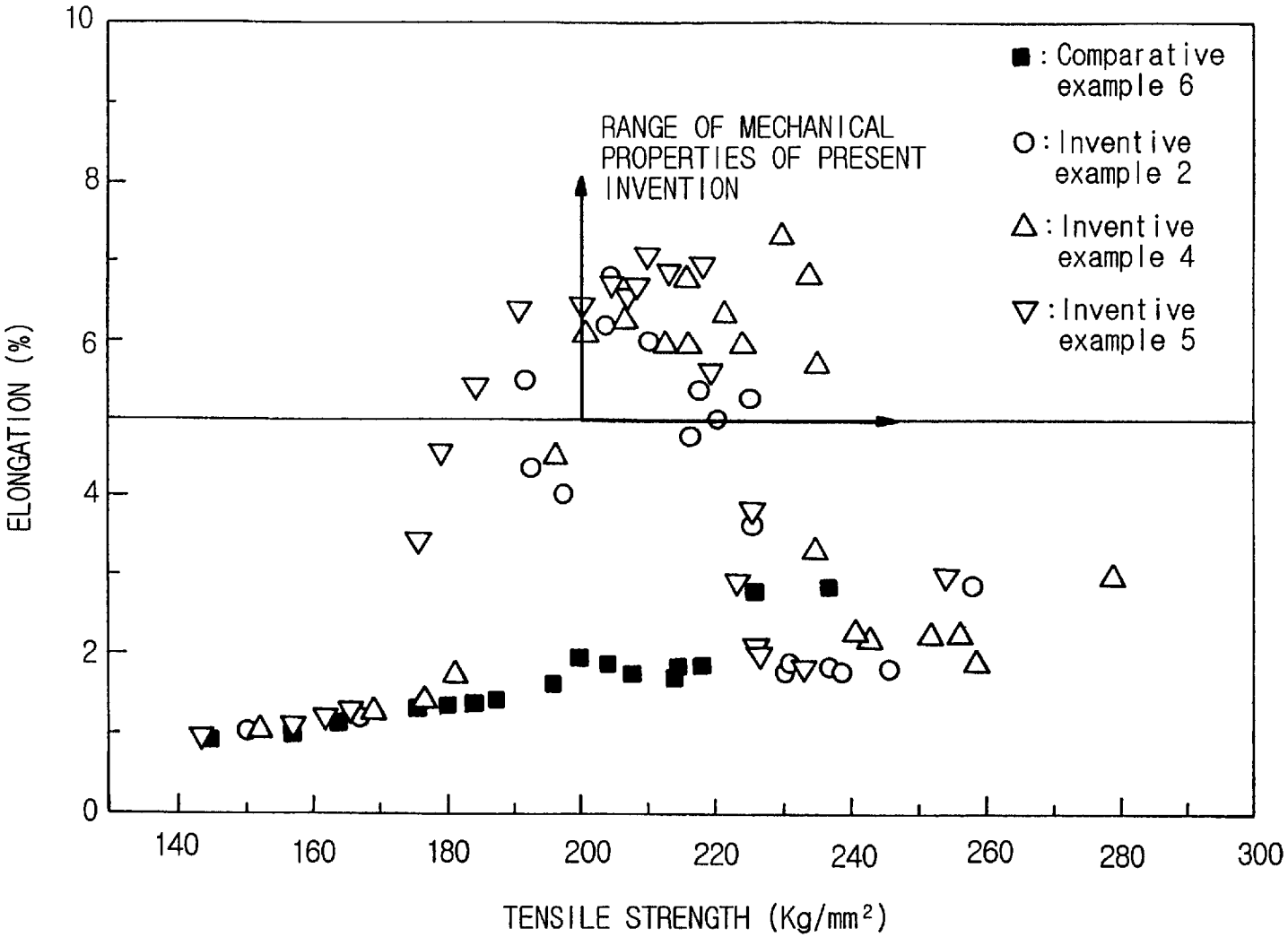
FIG. 2 is a graphical illustration showing the relationship of the elongation to the tensile strength of the steel wire which is obtained by carrying out bluing.

After carrying out the bluing, the relationship of the tensile strengths of the wire rods to their elongations is illustrated in FIG. 2. It was the general trend that if the temperature of the Pb bath was raised, or if the treating time period was extended, then the tensile strength was lowered. As shown in FIG. 2, the comparative example 6 could not secure an elongation of 5% over the entire temperature and time ranges, while when the inventive examples 2, 4 and 5 were subjected to a bluing treatment at a temperature of 450–550° C. for 2–60 seconds, there were obtained mechanical properties such that the tensile strength was 200 Kg/mm$^2$ or more, and the elongation was 5% or more.

These mechanical properties of the inventive examples 2, 4 and 5 were almost comparable to the comparative examples 3 and 5 of Table 2, which show a tensile strength of 200–230 Kg/mm$^2$ and an elongation of 7% when the bluing was carried out after carrying out the patenting. Accordingly, in the present invention, a high strength high ductility steel wire could be manufactured despite the skipping of patenting. Thus, in the present invention, the alloy element system, the cooling after the hot rolling, and the drawing strain are properly controlled. Then bluing is carried out at a temperature of 450–550° C. for 2–60 seconds. In this manner, in spite of skipping the patenting, there are obtained a tensile strength of 200 Kg/mm$^2$ or more and an elongation of 5% or more, thereby obtaining a high strength high ductility steel wire.

According to the present invention as described above, high strength high ductility wire rods and steel wire are manufactured by properly controlling the alloy elements and the structure. Further, the high strength steel wire can be manufactured even by skipping patenting, and thus, an industrially useful material manufacturing method is provided.

What is claimed is:

1. A high drawability wire rod for making high strength steel wire, comprising:

a steel containing, in wt %, 0.4–0.65% of C, 0.1–1.0% of Si, 0.1–1.0% of Mn, 0.3% or less of Cr, 100 ppm or less of B, Fe and other unavoidable impurities;

the steel further containing 0.02% or less of one or more elements selected from a group consisting of Ti, Nb and V; and the steel having a degenerated pearlite structure with pro-eutectoid ferrite of 10% or less and 6–10% of cementite.

2. A method for manufacturing high drawability wire rod for making high strength steel wire, comprising the steps of:

providing a billet containing, in wt %, 0.4–0.65% of C, 0.1–1.0% of Si, 0.1–1.0% of Mn, 0.3% or less of Cr, 100 ppm or less of B, Fe and other unavoidable impurities, and further containing 0.02% or less of one or more elements selected from a group consisting of Ti, Nb and V;

hot-rolling the billet to form a wire rod;

cooling the wire rod after the termination of hot-rolling at a temperature of 1100°–1000° C.; and continuously cooling the wire rod at a cooling rate of 10°–30° C./sec.

3. A high strength steel wire comprising:

a steel containing, in wt %, 0.4–0.65% of C, 0.1–1.0% of Si, 0.1–1.0% of Mn, 0.3% or less of Cr, 100 ppm or less of B, Fe and other unavoidable impurities;

the steel further containing 0.02% or less of one or more elements selected from a group consisting of Ti, Nb and V;

the steel having a degenerated pearlite structure with pro-eutectoid ferrite of 10% or less and 6–10% of cementite; and the steel having a tensile strength of 200 Kg/mm$^2$ or more and an elongation of 5% or more.

4. A method for manufacturing a high strength steel wire, comprising the steps of:

providing a billet containing, in wt %, 0.4–0.65% of C, 0.1–1.0% of Si, 0.1–1.0% of Mn, 0.3% or less of Cr, 100 ppm or less of B, Fe and other unavoidable impurities, and further containing 0.02% or less of one or more elements selected from a group consisting of Ti, Nb and V;

hot-rolling the billet to form a wire rod, then continuously cooling the wire rod at a cooling rate of 10–30° C./sec;

drawing the wire rod into steel wire; and bluing the steel wire at a temperature of 450–550° C. for 2–60 seconds.

5. The method as claimed in claim 4, wherein the cooling carried out after terminating a hot rolling at a temperature 1100–1000° C.

6. The method as claimed in claim 4, wherein said drawing step is carried out to a drawing strain of 3.5 or less.

7. The method as claimed in claim 5, wherein said drawing step is carried out to a drawing strain of 3.5 or less.

* * * * *